US005327704A

United States Patent [19]

Hoekzema et al.

[11] Patent Number: 5,327,704

[45] Date of Patent: Jul. 12, 1994

[54] METHOD AND APPARATUS FOR PACKAGING BREAD LOAFS INTO BAGS

[75] Inventors: Aldert W. Hoekzema; Gerard Dietz, both of Utrecht, Netherlands

[73] Assignee: Jongerius B.V., Netherlands

[21] Appl. No.: 967,137

[22] Filed: Oct. 27, 1992

[30] Foreign Application Priority Data

Nov. 15, 1991 [NL] Netherlands ..... 9101904

[51] Int. Cl.[5] ..... B65B 43/26; B65B 43/12

[52] U.S. Cl. ..... 53/459; 53/570; 53/252

[58] Field of Search ..... 53/459, 570, 252, 469, 53/455, 562

[56] References Cited

U.S. PATENT DOCUMENTS

| | | | |
|---|---|---|---|
| 3,453,800 | 7/1969 | Mahncke | 53/252 X |
| 3,699,746 | 10/1972 | Titchenal et al. | 53/570 |
| 3,881,296 | 5/1975 | Bate | 53/459 X |
| 4,616,472 | 10/1986 | Owensby et al. | 53/570 X |
| 4,624,100 | 11/1986 | Lesch | 53/252 X |
| 4,760,684 | 8/1988 | Crosby | 53/459 |
| 5,052,544 | 10/1991 | Anderson | 53/252 X |
| 5,070,677 | 12/1991 | Hicks | 53/459 X |
| 5,152,124 | 10/1992 | Ishii et al. | 53/570 |

*Primary Examiner*—Horace M. Culver

*Attorney, Agent, or Firm*—St. Onge, Steward Johnston & Reens

[57] ABSTRACT

In a method of packaging sliced loafs into bags, each loaf is supplied from a slicing machine and is pushed into an opened bag by pusher means. The bags are supplied laterally connected within a strip of bags and each loaf is then pushed transverse to its direction of supply into the laterally held opened bag by the pusher means. The pusher means is circulated within a closed path. The invention also includes an apparatus for performing this method and a foil strip of bags for use in the apparatus.

15 Claims, 2 Drawing Sheets

METHOD AND APPARATUS FOR PACKAGING BREAD LOAFS INTO BAGS

The present invention relates to a method of packaging, is sliced, loafs into bags, wherein each loaf is supplied and is pushed into an opened bag by pusher means.

For packaging loafs of bread many methods have been developed in the past. In one well known method, the loafs are conveyed in their longitudinal direction and are pushed by pusher means arranged above the conveyer into a bag held in readiness in longitudinal direction of the conveyor. In an other method, the loafs are conveyed transverse to their longitudinal direction through a conveyer, wherein at the end of the conveyer a bag is pulled over the loaf, whereafter the loaf is discharged.

Both these prior art methods have the disadvantage that the introduction of the loaf into the bag is effected in the conveying path of the loaf so that a failure in leading a loaf into a bag leads to a stagnation in the supply of loafs and bags necessitating an immediate stop of the supply to relieve the stagnation. Furthermore, the known methods have a limited handling capacity.

It is an object of the present invention to provide a method of the type mentioned in the preamble, in which these disadvantages are removed in an effective way.

For this purpose the method according to the invention is characterized in that the bags are supplied laterally connected within a strip of bags and each loaf is then pushed transverse to its direction of supply into the laterally held opened bag by the pusher means which is circulated within a closed path.

Due to these features the loafs are loaded laterally of the supply path of the loafs into the respective bags, so that a failure in leading the loaf into the bag does not directly lead to stagnation. Because the pusher means is circulated instead of reciprocated it is possible to obtain a higher speed because a net loaf is allowed to be supplied when the pusher means is passed further to its initial position. Also the supply of the bags within a strip promotes both the reliability and the maximum capacity.

A further increase of the operative speed is obtained if the bag containing the loaf is already conveyed further when the pusher means is still within the bag.

In this manner it is even possible to convey a bag already further if the pusher means has not yet fully pushed the loaf to the bottom of the bag. The movement of the pusher means may be finished during the further conveying movement of the bag. This feature is particularly useful if more than one pusher means is used.

A further improvement of the reliability of the method is obtained when the laterally connected bags are gripped at the opening edges and are forcibly opened, and wherein the bags, prior to the insertion of a loaf, are disengaged a part of their length from their closed end.

Due to this feature the loaf can easily expand a bag without the adjacent bags interfering with this expansion and without necessitating the bag to be opened by pressurized air.

Preferably the bags are fully separated from each other after the introduction of the loaf, and it is an option to seal their open ends.

In this manner a fully automatic packaging of the loaf can be effected.

The invention also includes an apparatus for packaging loafs into bags by means of the method as described above, comprising a supply conveyor for the loafs, means for supplying a bag and holding it in an open condition, and pusher means for pushing a loaf into the respective bag, the apparatus according to the invention being characterized in that laterally of the supply conveyor for the loafs there are arranged conveying and guiding means for conveying and opening bags by means of their opening edges and supplied within a strip, the pusher means being attached to circulating means at the end of the supply conveyor such that the pusher means is circulated within the plane of the supply conveyor and is adapted to slide each loaf transverse to the direction of supply of the supply conveyor and laterally into the bag held open by the conveying and guiding means.

With this apparatus it is possible to obtain a high handling capacity in a reliable manner. The fact that the bags are supplied laterally connected within a strip also assists therein. This strip may either be supplied from a roll or from a container in which the strip is folded zig zag shaped.

The invention also includes a foil strip for use in the method and apparatus, respectively, described herein before, which foil strip is characterized by a plurality of bags laterally interconnected by a tear off line, and parts forming the bag being interconnected from the lower closed end of the bag up to a distance from the opening edges of the bag and leaving two loose flaps in the extension of said parts and on both sides of the opening of the bag.

The invention will hereafter be elucidated with reference to the drawing showing an embodiment of the invention by way of example.

Figure 1:
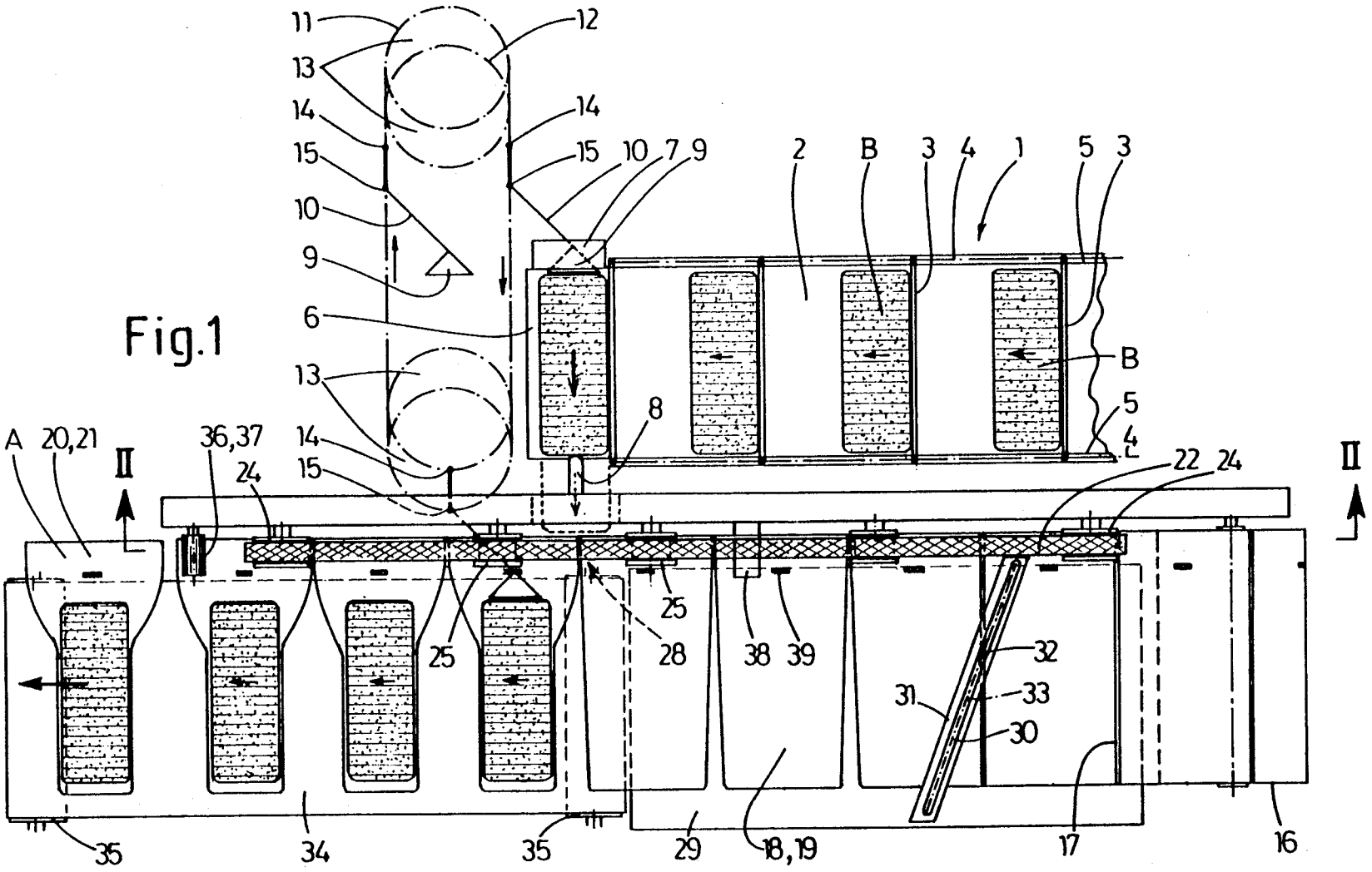
FIG. 1 is a very schematic plan view of an apparatus for packaging sliced loafs of bread into a bag in accordance with the invention.

The drawing, and in particular FIG. 1, shows that the exemplary embodiment of the apparatus for packaging loafs of bread B each into a bag A comprises a supply conveyor 1. This supply conveyor 1 joins in a way not shown to the exit of an automatic bread slicing machine. The supply conveyor 1 is provided with a horizontal smooth table 2 over which the cut loafs B are slid by means of push rods 3 extending transversely over the table. The push rods 3 have their ends fixed to a conveying means, such as a chain 4, guided in a closed path and the conveying part of which extends parallel to the table 2 so that the push rods 3 move at a small distance above the table 2.

The loafs B are conveyed transverse to their longitudinal direction, that is in a direction parallel to their slices. The supply conveyor 1 has at a distance above the face of the table 2 and above the chain 4 a longitudinal rim 5 on each longitudinal side, said longitudinal rims being spaced from each other such that the loafs B are allowed to pass between them but the slices are prevented by the longitudinal rims from falling outwardly.

At the discharge end of the supply conveyor 1 there is arranged a support plate 6 on a slightly lower level than the table 2. Each loaf is deposited on this support plate 6 by the respective push rod 3 when this push rod 3 is turned around by the chains 4 to the return part. On this support plate 6, the heels of the loaf B are laterally supported, on one hand by a horizontal retaining rim 7 and on the other hand by a flexible retainer 8.

Behind the support plate 6, that is as seen in the direction of conveyance of the supply conveyor 1, there are arranged means for pushing away the respective loaf B from the support plate 6 in its longitudinal direction, that is transverse to the direction of conveyance of the supply conveyor 1. This means comprises at least one, but preferably two or, as shown in the drawing, three pusher members 9. These pusher members 9 are guided in an oval path, of which the straight portions extend transverse to the direction of conveyance of the supply conveyor 1, such that the pusher member 9 moves over the support plate 6 during one of its straight trajectories so that it may push off a loaf B from the support plate 6. For this purpose, each pusher member 9 has an arm 10, attached to a first chain 11 and a second chain 12. Both chains 11, 12 are guided in an oval path along sprocket wheels 13 or like guide means, the chains extending parallel one at a distance above the other, but are relatively off-set a distance in their longitudinal direction. The arm 10 is connected to the first chain 11 in a connecting point 14 and to the second chain 12 in a connecting point 15. The connecting points 14 and 15 are spaced a horizontal distance corresponding to the off-set distance of the chains 11 and 12. In this manner, the pusher members 9 are circulated in a constant orientation within a horizontal path.

Figure 3:
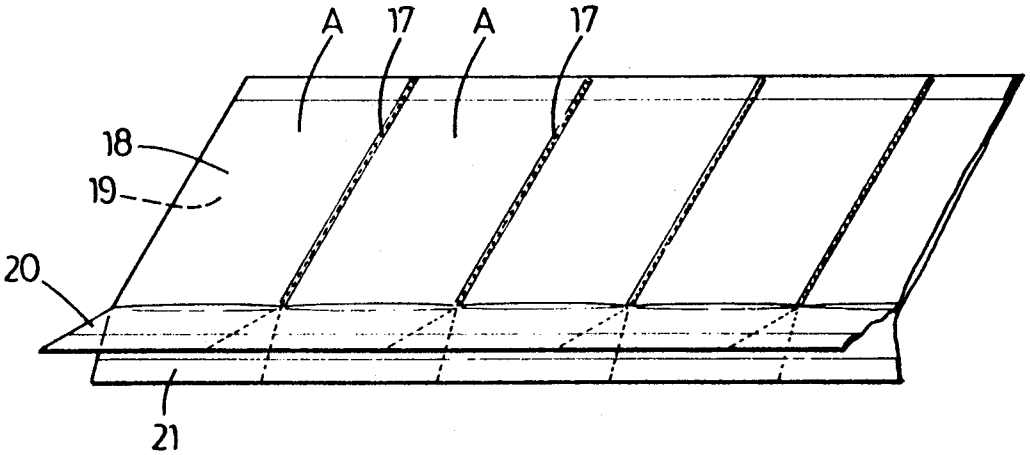
FIG. 3 is a perspective view of a portion of a foil strip including bags for use in the apparatus of FIG. 1 and 2.

As shown by FIG. 1, sideways of the supply conveyor 1 there are arranged means for supplying and guiding the bags A which are supplied in the form of a plastic foil strip, for example from a supply roll 16, but it is also possible to supply the foil strip from a container in which the foil strip is zig zag folded. As shown most clearly in FIG. 3, the bags A are laterally connected to each other through tear lines 17 extending the full length of the bags A. Both parts 18 and 19, from which each bag A is formed are, starting from the closed end of the bags A, not interconnected along the full length so that two flaps 20 and 21 remain at the open end of each bag A. These remaining flaps 20 and 21 are used for transporting and opening the bags A, as will be explained later on.

Figure 2:
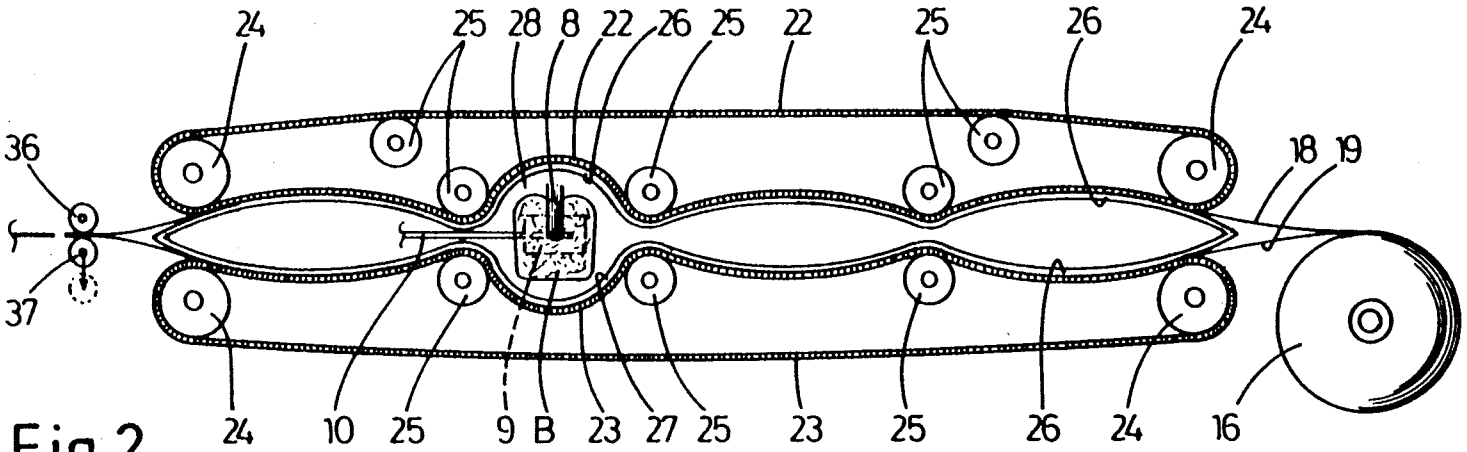
FIG. 2 is a very schematic sectional view along the line II—II of FIG. 1.

In FIG. 1, but particularly in FIG. 2, there are shown means for conveying the bags A and holding them open for introduction of the loaf B. These means comprise in the embodiment shown by way of example two endless conveying members 22, 23 which substantially form their mirror image and are arranged one at a distance above the other within a vertical plane. The endless conveying members 22, 23 consist in this case of synthetic geared belts guided around end rollers 24 and along guide rollers 25. One of the end rollers 24 is driven to circulate the endless conveying members 22, 23 respectively. The outer side of the endless conveying members 22, 23 is provided with a surface having a high coefficient of friction. The endless conveying members 22, 23 slide along a corresponding stationary guide track 26, 27 respectively on their side facing each other, said guide tracks 26 and 27 include on their side facing the corresponding endless conveying member 22, 23 a surface having a low coefficient of friction, and are equipped, for instance, with a teflon coating. The endless conveying members 22, 23 together with their corresponding stationary guide tracks 26, 27 form a nip in which the remaining flaps 20, 21 of the strip of bags A can be gripped for conveying the bags A at their open end and for moving both flaps 20, 21 away from each other to open the bags A in the required position. For this purpose the stationary guide tracks 26, 27 are configured in extension of the support plate 6 such that an eye or passage opening 28 is provided. In this manner, each bag is forcibly opened in a very reliable manner so that a loaf B may easily be pushed into this bag A.

In FIG. 2 is also shown that the stationary guide tracks 26, 27 and the conveying part of the endless conveying members 22, 23 follow a wavy path, wherein the stationary guide tracks 26, 27 follow a convex path between the guide rollers 25 and the end rollers 24, respectively, and the endless conveying members 22, 23 follow a concave path, that is they extend on the outside of the curve. This is done to ensure a proper abutment between the endless conveying members 22, 23 and the stationary guide tracks 26, 27 also between the guide rollers 25, where the endless conveying members 22, 23 are not urged against the stationary guide tracks 26, 27 by the guide rollers, and in this manner the flaps 20, 21 of the bags A are gripped well along the entire length of the nip.

As further shown by FIG. 1, the bags A are further supported in their none-filled condition by a support face 29 during their transport by the endless conveying members 22, 23. As seen in the direction of conveyance of the strip of bags A at a distance before the passage opening 28 there is formed a slit in this support face 29, which inclines to the strip of bags A, and a slit 30 coinciding therewith is also formed in a plate part 31 below which the strip of bags A is passed. These slits are intended to allow the passage of a vertically upwardly projecting tearing pin 32 which is attached to a chain 33 circulating within a vertical plane. The tearing pin 32 is adapted to separate the individual bags A at a position of the tear line 17 along a length from their closed end, as will be explained further on in the description of the operation of the apparatus.

From the passage opening 28 on, the bags with the loaf introduced therein are supported by a conveyor belt 34 passed around driven rollers 35. To further facilitate the introduction of loaf B into a corresponding bag A the rollers 35 are arranged slightly inclined so that the conveying part of the conveyor belt 34 inclines slightly downwardly from the passage opening 28.

FIG. 1 and 2 further show that at the end of the nips formed by the endless conveying members 22, 23 and the stationary guide tracks 26, 27 there are arranged two rollers 36, 37 one above the other, wherein one of the rollers 36, 37 is movable in vertical direction and may be pressed against the other roller 37, 36, while one of the rollers 36, 37 is driven with a high rotational speed. These rollers 36, 37 are adapted to tear off every bag A from the foil strip following thereafter.

The method to be performed by the apparatus described herein before and shown in the drawings is as follows.

The loafs B are supplied one by one from a slicing machine by means of the supply conveyor 1 and are deposited onto the support plate 6 at the end of the supply conveyor 1. As soon as the loaf B rests on the support plate 6, a pusher member 9 arrives at the loaf B standing ready and pushes it off the support plate 6 into a bag A held open around the passage opening 28. This bag A forms part of the foil strip in which the bags A are laterally interconnected. The strip is supplied from a supply roll 16. Thereafter the free flaps 20, 21 on both sides of the opening of each bag A are passed into the corresponding nips between the stationary guide tracks 26, 27 and the endless conveying means 22, 23. The endless conveying means 22, 23 engage with their surface having a high coefficient of friction the corresponding flaps 20, 21 and pull the flaps along the smooth stationary guide tracks 26, 27. The bags A are thereby supported by the table 29 and are passed under the plate part 31. During the movement of the bags A, the chain 34 synchronized therewith is also moving together with the tear pin 32 coming up through the respective slit in the support face 29 as soon as the tear line 17 between two adjacent bags A has arrived. The bags A are kept down by the plate part 31 when the tearing pin 32 is pushed through the foil strip at a position of the tear line. Then the tearing pin 32 moves further along the chain 33. Due to the oblique orientation of the chain, the foil strip of the bags A may be conveyed further when adjacent bags A are separated from each other over a distance by the tearing pin 32 so that tearing the bags A along a part of their length does not delay the process. After passing the tearing pin 32, the adjacent bags A are then only interconnected at a position of their flaps 20, 21.

As mentioned, each bag A is precisely aligned with the passage opening 28 to allow the introduction of a loaf B. Positioning the bags A in this manner may take place by means of a detection element 38 mounted stationary to the apparatus and cooperating with reflection spots 39 provided on the bags. When a bag A is aligned with the passage opening 28, the drive of the endless conveying means 22, 23 is interrupted momentarily in order to allow the pusher member 9 to load a loaf B into the bag A. The drive of the endless conveying means 22, 23 is started already again when the loaf is not yet fully pushed to the bottom of the bag and the pusher member 9 is still within the bag A. Due to the arrangement and the path of the chains 11, 12 the pusher member 9 moves a distance along with the respective bag A and the loaf B during which the pusher member 9 completes its stroke and then withdraws from the bag A again. The arm 10 of the pusher member 9 may pass between the stationary guide tracks 26, 27 at a position of the guide rollers 25, while the pusher member is allowed to retract between the stationary guide tracks 26, 27 in a position where the stationary guide tracks 26, 27 are moved away from each other. Due to the fact that the bag A and the pusher member 9 move together a very high handling capacity may be obtained because the next pusher member 9 is already allowed to load the next loaf B into the next bag A if the preceding bag A has been conveyed beyond the passage opening 28 and the next bag A is aligned with the passage opening 28.

After the bags A are filled with the loafs B, the bags are further conveyed by the endless conveying means 22, 23 thereby supported by the conveyor belt 34. When the flaps 20, 21 leave the nip between the stationary guide tracks 26, 27 and the endless conveying means 22, 23, the flaps 20, 21 of each bag A are passed between the two rollers 36, 37 and as soon as this bag A has completely left the nip, the lower roller 37 is moved upwardly such that the flaps 20, 21 of the bag A are pinched between the rollers 36, 37 and due to the fast rotation of the roller 36 the bag A is suddenly pulled further thereby causing this bag A to be torn loose from the next bag A over the last portion of the tear line. The bag A which is torn loose may then be passed, for example, to a following machine where the open end of the bag is closed by means of a clip or in another way.

From the foregoing it will be clear that the method and apparatus according to the invention allows a high speed packing of the loafs. In the embodiment of the method and apparatus shown by way of example it is possible to package 130 loafs per minute. This was not yet possible with the prior art methods and apparatuses, thereby often necessitating two packaging apparatuses for each bread slicing machine in order to package the half loafs sliced by the machine. According to the present invention only one apparatus is necessary in such cases.

The invention is not restricted to the embodiment shown in the drawing and described herein before by way of example, which may be varied in different manners within the scope of the invention. It is, for instance, possible to use another kind of displacement mechanism for moving a pusher member, such as a linkage mechanism for moving the pusher member within the desired track. Furthermore, it is possible to use a foil strip in the apparatus, wherein the bags are only formed in the apparatus by means of sealing. The drive of the several parts takes place either by coupled drive means commonly driven by a single motor, or driven by different motors, such as electric motors, which are synchronized.

What is claimed is:

1. A method of packaging loaves as these are conveyed in a supply direction to a packaging station where the loaves are fed into bags, comprising the steps of:

conveying loaves, one after another, along a delivery path aligned along the supply direction to the packaging station where a foremost loaf is to be fed into a bag;

while the loaves are being so conveyed, supplying preformed bags connected in a strip to and past the packaging station along a supply path;

halting movement along the supply direction of the foremost loaf when it is at the packaging station;

opening a foremost bag in the strip of bags as the foremost bag arrives at the packaging station at a lateral position with respect to the foremost loaf;

circulating a loaf pusher along a closed path which overlaps a lateral insertion path that leads from the position of the halted foremost loaf to the laterally-spaced opened bag to push the foremost loaf into the foremost opened bag;

during the time that the foremost loaf is laterally pushed into the foremost opened bag, reducing movement of the strip of bags to enable the foremost loaf to be inserted into the opened bag by the circulating loaf pusher; and resuming movement of the preformed bags after a loaf has been inserted into an opened bag to move the loaf in the bag towards a discharge and bring a new bag to the packaging station while the loaf pusher continues to circulate.

2. The method according to claim 1 wherein the loaf pusher circulating step comprises circulating the loaf pusher along a path which partially overlaps the supply path of the bags after their movement past the packaging station.

3. The method according to claim 1, wherein the bag supplying step comprises gripping connected bags at opening edges thereof and forcibly open the bags, and wherein the connected bags, prior to the insertion of a loaf, are partially disengaged from each other along.

4. The method according to claim 3, wherein the step of pushing the loaves into bags is followed by the step of fully separating the bags from each other.

5. An apparatus for packaging loaves into bags having separable edges to form an opening through which a loaf can be inserted, comprising:

means for conveying the loaves along a supply direction to a packaging station;

means for conveying bags which are connected in a strip along a supply path to a packaging station position that is laterally-spaced from a foremost loaf conveyed thereto;

means for separating said separable edges to open a bag conveyed to the packaging station so as to enable the foremost loaf to be inserted into the opened bag along an insertion path;

at least one loaf pusher; and, means for circulating the loaf pusher along a closed path which overlaps the insertion path so as to push the foremost loaf from its position at the packaging station laterally into the opened bag.

6. The apparatus according to claim 5, wherein the circulating loaf pusher means includes means for moving the loaf pusher in an oval path having main axis which extends transverse to the supply direction.

7. The apparatus according to claim 6, wherein the loaf pusher circulating means comprises two spaced parallel chains arranged in oval paths, said chains being off-set with respect to a longitudinal direction of the oval, and a loaf pusher having a connecting arm connected to both chains.

8. The apparatus according to claim 5, wherein the loaves conveying means comprises two elongate nips, in which separable edges of the bags are respectively held at a distance from each other, said nips being sufficiently spaced at the packaging station to move the separable edges apart and form a bag opening sufficient to allow the passage of a loaf into a bag.

9. The apparatus according to claim 8, wherein the loaf-conveying means includes a stationary guide track having a surface with a low coefficient of friction, an endless conveyor having an engagement surface with a high coefficient of friction, said stationary guide track being in abutting relationship with the engagement surface of the endless conveyor.

10. The apparatus according to claim 5, and further including tear-off means positioned along the supply path of the bags for separating the bags from each other along a part of their connected lengths.

11. The apparatus according to claim 10, wherein the tear-off means includes a circulating endless conveying means placed along the supply path of the bags and having a tear pin mounted thereto for intersection of the connected strip of bags during circulation of the tear pin.

12. The apparatus according to claim 5, wherein, at the end of the means for conveying the bags there is a second separate conveying means positioned to engage a bag released from the bag conveying means to discharge a loaf-filled bag with greater speed.

13. The method according to claim 1, wherein the loaf pusher circulating step extends along a lateral insertion path which extends laterally past the delivery path of the loaves so as to avoid the filling of bags in interference with the loaves moving along the supply direction.

14. The method according to claim 1, wherein the closed path of the circulating loaf pusher is away from the discharge for packaged loaves.

15. An apparatus for packaging loaves into bags having separable edges to form an opening through which a load can be inserted, comprising:

means for conveying the loaves along a supply direction to a discharge end of the conveying means;

receiving means arranged at said discharge end for receiving a foremost loaf to be packaged;

means for individually gripping said separable edges of the bags and conveying the bags, which are connected in a strip, along a bag moving path to and past the receiving means at a position that is laterally-spaced from a foremost loaf;

said gripping and conveying means including guide means at the receiving means for separating the upper edges as the bags are conveyed thereto to force the bags open to receive loaves to enable the foremost loaf to be inserted into the opened bag along an insertion path that is generally transverse to the supply direction;

at least one loaf pusher; and means for circulating the load pusher along a closed path which overlaps the insertion path and a portion of the bag moving path so as to push the foremost loaf from its position at the receiving means laterally into the opened bag and remain in operative contact with the loaf for a distance until the recirculating path of the loaf pusher causes it to retract from the loaf filled bag.

* * * * *